US006009846A

United States Patent [19]

Walker, Jr.

[11] Patent Number: 6,009,846

[45] Date of Patent: Jan. 4, 2000

[54] COMBINATION AIR-FILTER/AIR-OIL SEPARATOR WITH INTEGRAL VACUUM REGULATOR

[76] Inventor: Robert A. Walker, Jr., 26954 White Horse Pl., Santa Clarita, Calif. 91351

[21] Appl. No.: 09/035,557

[22] Filed: Mar. 5, 1998

[51] Int. Cl.[7] ..... F02B 77/00

[52] U.S. Cl. ..... 123/198 E; 123/574; 55/DIG. 19; 55/DIG. 21

[58] Field of Search ..... 123/41.86, 198 E, 123/572, 573, 574; 55/DIG. 19, DIG. 21

[56] References Cited

U.S. PATENT DOCUMENTS 5,471,966 12/1995 Feuling ..... 123/572
5,579,744 12/1996 Trefz ..... 123/573

*Primary Examiner*—Noah P. Kamen

*Attorney, Agent, or Firm*—Christie, Parker & Hale, LLP

[57] ABSTRACT

The combination apparatus silences and filters air flow, separates air-contaminant mixtures, and maintains a regulated vacuum therein. An air filter joins an annular housing which has an outer wall and a channel defining a central axis, the channel having a primary gas inlet coupled to the air filter and a primary gas outlet and a channel wall. The apparatus has a secondary inlet port passing through the outer wall. A secondary outlet port defines an opening in the channel wall such that there is no straight line flow path between the secondary inlet and the secondary outlet. An air silencer is contained within the channel. A passageway between the secondary inlet and the secondary outlet is defined exteriorly by the outer wall and interiorly by the channel wall. A vacuum regulating means is disposed within the annular housing and is positioned next to an opening in the secondary outlet to regulate the amount of vacuum imposed within the passageway so that it does not exceed a determined maximum.

21 Claims, 6 Drawing Sheets

COMBINATION AIR-FILTER/AIR-OIL SEPARATOR WITH INTEGRAL VACUUM REGULATOR

FIELD OF THE INVENTION

The present invention relates generally to air-oil separators and, more specifically to a closed system air-oil separator comprising an air filter and an integral vacuum regulator for use in silencing and filtering air in a flow line input to an engine, separating oil from a contaminated engine atmosphere, and regulating the pressure of the engine atmosphere.

BACKGROUND OF THE INVENTION

Prior U.S. Pat. Nos. 3,721,069, 4,184,858, 4,724,807, 5,140,957, and 5,479,907 relate to air-oil separators used in conjunction with internal combustion engines. The specifications and claims of these patents are incorporated herein by reference. The air-oil separators disclosed in these patents comprise mechanical means disposed therein for mechanically separating oil from an air-oil mixture routed thereto from an engine crankcase. More specifically, such air-oil separators include one or more baffle and/or filter material for effecting such oil separation. The separated oil component is removed from the separator for either further treatment or for routing back to an engine crankcase.

Increasingly stringent environmental regulations, and a heightened consciousness of environmental conservation, has mandated cleaner operation of hydrocarbon powered sources such as automobiles, boats, trucks, motorcycles, or the like. As a result, blow-by devices such as pollution control valves have become required standard equipment for all automobiles. These blow-by devices capture air-oil emissions from the crankcase of a hydrocarbon burning internal combustion engine and communicate them in a closed system to the air intake system for combustion. The emissions generated from the crankcase of diesel engines, for example, are heavily ladened with oil and other heavy hydrocarbons. Accordingly, air-oil separators such as those previously described have been developed in an effort to make the operation of such engines cleaner and more efficient. Such devices have been developed to both silence and filter inlet air routed to an intake of an engine, separate oil and other hydrocarbons emitted from a contaminated engine atmosphere, and regulate the pressure within an engine crankcase.

The '957 and '907 patents each discloses an air-oil separator system comprising a combined air-filter/air-oil separator device that incorporates a particular arrangement of baffles, filtration material, and/or arrangement of airflow passages therethrough to remove oil from an air-oil mixtures passing therethrough from an engine crankcase. Each such system also includes a vacuum limiter that is external from the separator device and that is connected in-line between the separator device and the engine crankcase to limit the amount of vacuum that is drawn on the crankcase by the separator device to a predetermined amount, thereby preventing unwanted oil passage from the crankcase into the separator under conditions of large vacuum.

Although air-oil separator systems using such separate vacuum limiters or regulators have proven effective in separating and removing oil from crankcase air-oil mixtures, such systems depend on the gravity flow of collected oil from the separator through an oil drain line that is connected to an engine block. The oil drain line in such systems include a check valve disposed therein to prevent the unwanted passage of oil from the engine block and into the separator under conditions of excessive vacuum within the separator. The oil collected in the separator passes through the check valve after a sufficient pressure head of oil is built up in the drain line. Under conditions where the air filter is allowed to become excessively dirty, the vacuum generated by the separator can become great enough so that the pressure head of oil in the drain line is insufficient to permit oil passage to the engine block, thereby causing the oil level in the drain line to rise and interfere with the efficient separating operation of the system. Additionally the need to install and position of such separate vacuum limiter on or near and engine of a modern vehicle has become an increasing challenge due to spatial limitations in the engine compartment.

It is, therefore, desired that an air-oil separator device be constructed in a manner that provides both crankcase vacuum regulation and internal separator device vacuum regulation to enhance the efficient oil separating, collection, and removal operations of the device. It is desirable that the device be constructed in a manner that does so without requiring additional space within an engine compartment for mounting. It is also desired that the air-oil separator device be easy to install and use without a need for special equipment or instruction.

SUMMARY OF THE INVENTION

The present invention comprises a combination air-filter/air-oil separator having an vacuum regulator disposed therein that provides a closed system with no moving parts for regulating/cleansing the environment of an internal combustion engine. The invention includes an annular air filter joined to an annular housing having an outer wall and a channel in the housing defining a central axis. The channel has a primary gas inlet and a primary gas outlet and a channel wall. The end of the channel coupled to the air filter is the primary gas inlet and the opposite end of the channel is the primary gas outlet. The annular housing has a secondary inlet port through the outer wall and a secondary outlet port defining an opening in the channel wall.

A silencer such as an annular sheet of perforated aluminum or other similar material is received within the channel wall, spaced away from the inner side of the channel wall, and also oriented on the central axis. Sound deadening material fills the space between the annular sheet of material and the inner side of the channel wall. A section of the perforated material and sound deadening material is cut away so as not to cover the secondary outlet in the channel wall.

The secondary outlet in the channel wall is formed in the wall such that there is no straight line flow path between the secondary inlet and the secondary outlet. A passageway between the secondary inlet and the secondary outlet is defined exteriorly by the inside surface of the outer wall and interiorly by the outside surface of the channel wall. The passageway may include one or more baffles for forming condensation/precipitation or adsorption surfaces for removing the oil from the air-contaminant mixture.

A vacuum regulating means is disposed within the combination separator housing and is positioned next to the secondary air outlet in the channel wall to regulate the amount of vacuum imposed within the passageway in the housing. The vacuum regulating means includes a diaphragm that is constructed to seal against an opening of the secondary air outlet when a differential pressure across the diaphragm exceeds a determined amount.

In one form, the invention is placed so that the channel is in-line with the air intake and the induction system for heavy engines. The filter end of the invention is coupled to the air intake line and the primary outlet is coupled to the induction system. The secondary inlet is coupled to an engine breather for the crankcase. An oil drain plug is provided in the annular housing for returning the filtered oil to the engine block. A check valve is coupled between the oil drain plug and the engine to prevent oil back flow due to existence of a higher vacuum in the separator than in the engine crankcase.

BRIEF DESCRIPTION OF THE DRAWINGS

These and other features and advantages of the present invention will become appreciated as the same becomes better understood with reference to the specification, claims and drawings wherein:

DETAILED DESCRIPTION OF THE PREFERRED EMBODIMENTS

The present invention is an improvement of the system described in U.S. Pat. Nos. 5,140,957 and 5,479,907, which are incorporated herein by reference. Combination air-filter/air-oil separators of this invention comprise an integral vacuum regulator disposed therein for both regulating the amount of vacuum that is imposed on an internal combustion engine crankcase, and regulating the amount of vacuum imposed within the air-oil separating chamber of the separator apparatus itself to optimize efficient separation, collection, and removal of oil.

Figure 1:
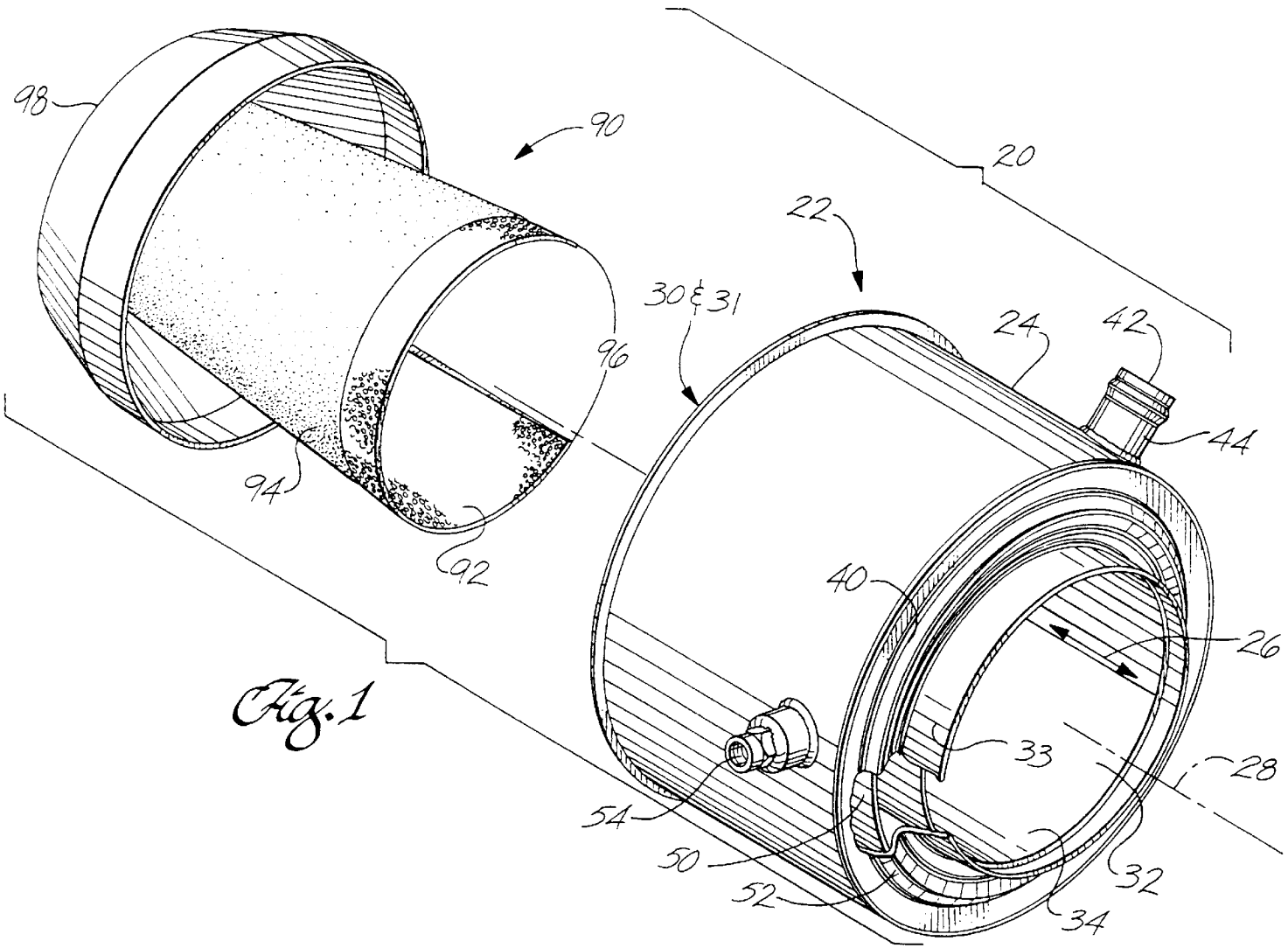
FIG. 1 shows an exploded perspective and partial cutaway schematic of a combination separator apparatus of this invention.

FIG. 1 shows a combination apparatus 20 for silencing and filtering engine intake air and separating contaminants (including oil and other heavy hydrocarbons) from pressurized air-contaminant mixtures routed to the apparatus from the engine crankcase. Only the silencer and separator aspects of the apparatus are shown. The apparatus is formed from an annular housing 22 having an outer wall 24. The outer wall may be formed from aluminum, sheet metal or other material suitable for withstanding the temperature and environment associated with internal combustion engines.

A channel 26 forms the central portion of the annular housing and defines an axis 28 about which the housing is substantially symmetrical. The channel has a primary gas inlet 30 at one of its end for receiving intake air therein. The primary gas inlet 30 is joined to an annular air-filter 100 (not shown in FIG. 1, see FIG. 6) which is also substantially symmetrical about axis 28. The channel 26 also has, at the opposite end from the primary gas inlet 30, a primary gas outlet 32, typically coupled to an air induction system for an engine. The channel has a channel wall 34 preferably formed from the same material from which the outer wall 24 was formed. The channel wall extends along axis 28 a distance greater than the length of the outer wall 24 forming an inlet flange 31 and an outlet flange 33 for coupling to respective hoses or ducts for conducting the primary air flow and for allowing continuous flow between the hoses or ducts and the channel 26. The inlet flange 31 is substantially the same as outlet flange 33, but faces in the opposite direction relative to the outlet flange. Air flows through the channel 26 from the inlet flange 31 to the outlet flange 32.

The outer wall and the channel are maintained in spaced apart relation with respect to each other through a pair of convoluted end surfaces 40. Only the convoluted end surface on the outlet flange end of the apparatus is shown in the drawings. Both convoluted end surfaces are riveted, crimped, or otherwise fastened to the channel walls at each flange. The convoluted end surfaces are attached in a manner such as that described in U.S. Pat. No. 4,724,807 to form an airtight, except as described below, hollow housing enclosure 22.

A secondary inlet port 42 extends through the outer wall 24 by means of 44, which is preferably riveted or spot welded to the outer wall 24. The secondary inlet port provides a gas flow path for air-oil mixtures from an engine crankcase into the interior of the annular housing 22. The secondary inlet port 42 is adapted to be coupled to a suitable attachment of an internal combustion engine as more fully described below. The annular housing 22 further includes a secondary outlet port 46 (shown in FIG. 2) opening in the channel wall 34.

An air-silencer 90 is contained within the channel wall 34. Spaced away from the inside surface of the channel wall 34, and also oriented on the central axis, is an annular or conical tube 92 of perforated aluminum or other similar material. Sound deadening material 94 fills the space between the annular piece of perforated material 92 and the inner side of the channel wall 34. A section 96 of both the perforated material and sound deadening material is cut away so as not to cover the secondary outlet 46 in the channel wall.

An annular cap 98 is welded or similarly attached to the ring formed by the primary gas inlet end of the annular perforated material 92. When the air-silencer 90 is installed in the channel 26, cap 98 fits neatly over the primary gas inlet flange 31 of the channel, preventing interruption of the fluid air flow over the primary gas inlet flange into the channel.

The beneficial noise reduction realized from the addition of the air-silencer has been measured to be in the range of 8.5 dB at a channel air flow rate of 1400 cubic feet per minute (noise level reduced from 122.0 dB to 113.5 dB). The combination apparatus may be constructed with or without the air-silencer installed with no effect on the overall operation of the apparatus.

The secondary outlet 46 is formed in the housing in such a way that there is no straight line flow path between the secondary inlet 42 and the secondary outlet. The interior of the housing defines a passageway for fluid and flow between the secondary inlet and the secondary outlet. The passageway is defined at the outermost extreme by the inside surface of the outer wall 24 and at the innermost extreme by the inside surface of the channel wall 34. As will be discussed more fully below, a baffle 50 is positioned in the housing between the outer wall and the channel wall and spaced from each. Both edges of the baffle extend into respective convolutions 52 in the convoluted end surfaces 40. As shown in FIG. 1, the baffle 50 contacts in the convoluted end a first convolution 52 formed as a ridge extending away from the interior of the housing. The edge of the baffle contacts the inside vertex formed by the ridge. In the preferred embodiment, the edges of the first baffle are sealed in the vertex with a silicone or epoxy sealer for preventing passage of the crankcase air between the baffle and the convoluted surface. The outer wall, the baffle and the channel wall are preferably concentric.

A drain coupling 54 is preferably centrally mounted between the edges of the outer wall 24 to allow oil to drain from the interior of the annular housing. A hose or other similar conduit may be attached to the coupling for routing the collected oil for further treatment or back to the engine block. A check valve is preferably coupled in a conventional manner between the hose and the engine block, to prevent back flow of oil from the crankcase to the interior of the annular housing. The valve is necessary because the vacuum level in the apparatus may be higher than vacuum level in the engine crankcase. The circumferential location of the drain coupling 54 with respect to the secondary inlet 42 will be determined by the final orientation of the housing with respect to the engine. Once the final orientation is determined, the drain coupling is mounted to the outer wall at the bottom of the housing so that the oil enters the coupling through force of gravity. However, for any given engine design, the position of the coupling will be the same.

In the remaining figures, identical elements are identically numbered and have the same structure and function as described above. Additional elements will now be described.

Figure 2:
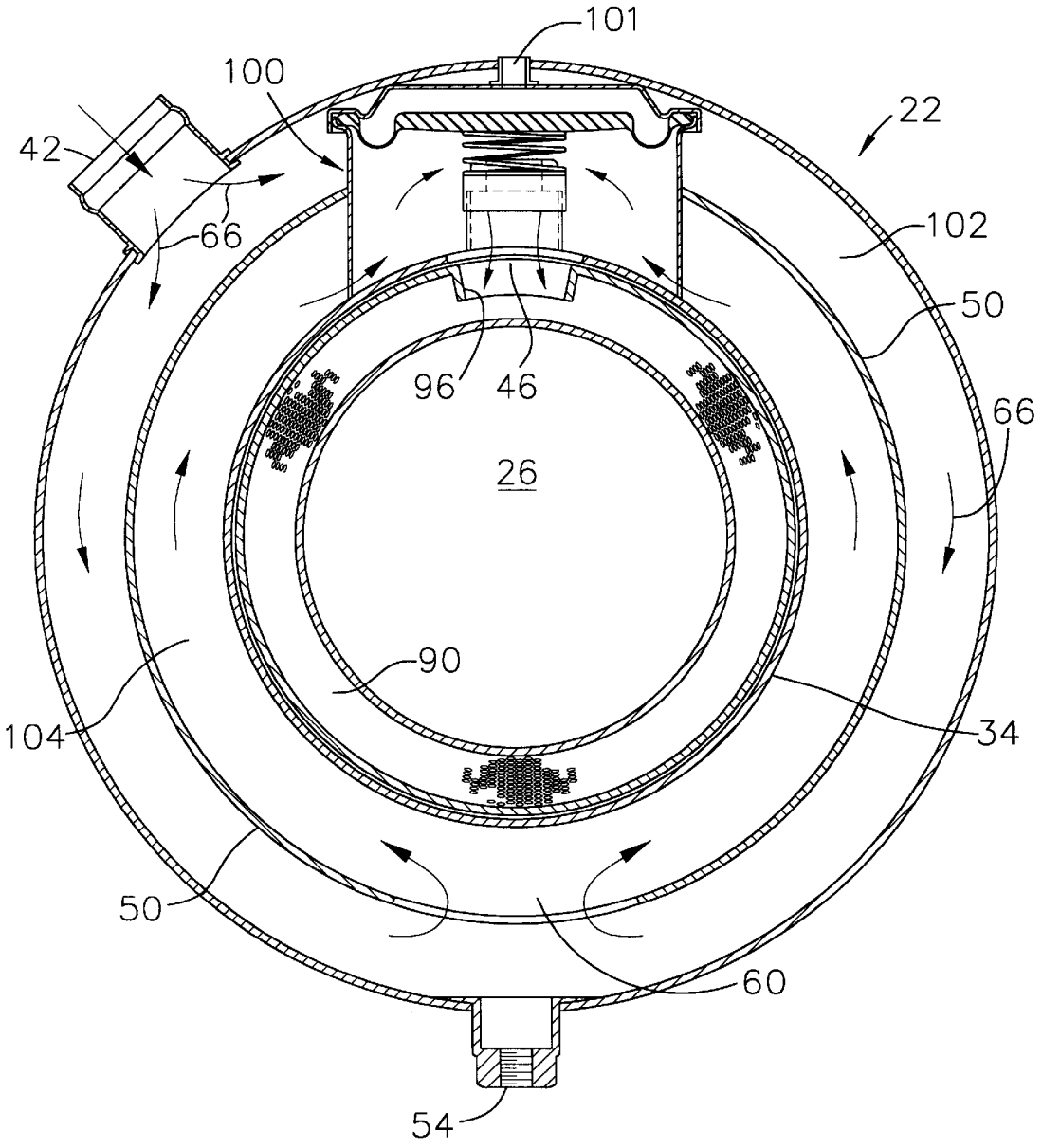
FIG. 2 is a vertical cross-section schematic end view of the apparatus of FIG. 1.

FIG. 2 is a cross sectional of the separator apparatus of FIG. 1 illustrating the air silencer 90 installed in the channel 26. The secondary inlet 42 is preferably oriented along the upper 180 degrees of the apparatus, however, its placement can vary depending on particular apparatus application. Accordingly, the secondary inlet 42 is illustrated as being in the upper left hand quadrant of the apparatus as illustrated in FIG. 2 for purposes of reference only. The secondary inlet 42 has a diameter sized to accommodate attachment with an engine crankcase attachment via conventional means, e.g., via a suitable hose or the like. In a preferred embodiment, the secondary inlet 42 has a diameter of approximately 1¼ inches. The drain 54 is located at the bottom of the apparatus to facilitate collection of oil from the apparatus by gravity flow. The single baffle 50 fits into a single convolution on the respective convoluted end surfaces 40 (shown in FIG. 1). In the embodiment shown in FIG. 2, the baffle opening 60 is located on a side of the housing substantially opposite that of the secondary inlet 42 and the secondary outlet 46.

A vacuum regulator 100 is disposed within the housing 22, i.e., is integral within the separator housing, between the inner and outer channel walls 34 and 24, respectively. The vacuum regulator 100 is positioned at the physical top of the apparatus approximately 180 degrees from the drain 54. A regulator vent 101 extends from the vacuum regulator through the housing for purposes of providing an ambient pressure within the regulator for proper diaphragm operation, as will be better described below. The vacuum regulator is positioned over the secondary outlet port 46 to control the amount of vacuum imposed within the apparatus housing, by the primary inlet air stream passing through channel 26, thereby regulating the flow of an air-oil mixture routed from an engine crankcase through the secondary inlet port 42 and into the apparatus housing.

The air-oil mixture passing into the apparatus housing 22 through the secondary inlet 42 is routed into a first airflow passageway 102 that is defined between the outer channel wall 24 and the baffle 50. As illustrated by arrows 66, an air-oil mixture entering the housing through the secondary inlet port 42 passes circumferentially downwardly within the first airflow passageway 102 around each side of the housing, around the vacuum regulator 100 and towards the oil drain 54 and baffle opening 60. As will be described in greater detail below, the vacuum regulator 100 is sealed to prevent the air-oil mixture from the secondary inlet 42 to pass to any other portion of the separator except the first airflow passageway 102. If desired, filter material and/or radial baffles may be used in the first airflow passageway for purposes of further reducing airflow velocity therethrough to enhance oil separation.

The air-oil mixture passes through the first airflow passageway 102 to the baffle opening 60 where it enters a second airflow passageway 104 that is defined between the baffle 50 and the inner channel wall 34. The air-oil mixture entering the second airflow passageway 102 is routed circumferentially upwardly around each side of the housing towards the vacuum regulator 100, where enters the vacuum regulator and is routed through the secondary outlet 46. The air exiting the secondary outlet 46 passes into the channel 26 where it is combined with intake air that is being passed therethrough and that is routed to the engine intake system for combustion.

As the air-oil mixture is passed through the first and second airflow passageways 102 and 104, respectively, it both loses velocity and comes into contact with the relatively cooler surfaces of the channel walls 24 and 34, and baffle 50. The combined reduction in velocity and cooling serves to separate the oil entrained within the entering mixture, where it flows by gravity to the bottom of the housing for collection and removal via the oil drain 54. Accordingly, the air that is routed through the second airflow passageway to the vacuum regulator is relatively oil free for mixing with the intake airflow for subsequent combustion.

Figure 3:
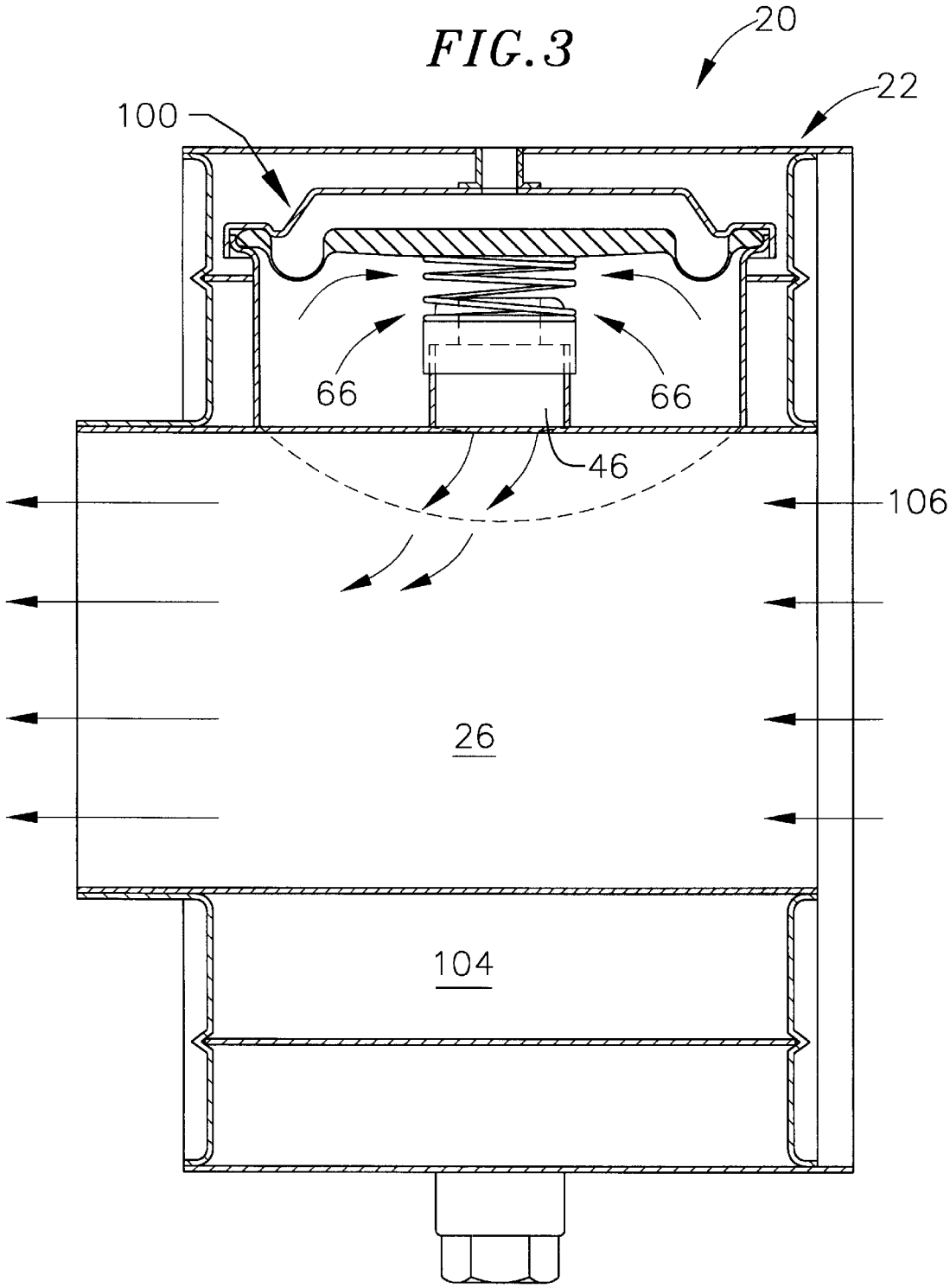
FIG. 3 is a vertical cross-section schematic side view of the apparatus of FIG. 1.

FIG. 3 is a side cross-sectional view of the separator apparatus 20, without the air filter/air silencer (as shown in FIG. 2), that further illustrates the placement of the vacuum regulator 100 within the apparatus housing 22, and further illustrates how the air 66 entering the vacuum regulator 100 from the second airflow passageway 104 is passed through the secondary outlet 46 into the channel 26, where it is combined with intake air 106 passing therethrough for routing to the engine intake system for subsequent combustion.

Figure 4:
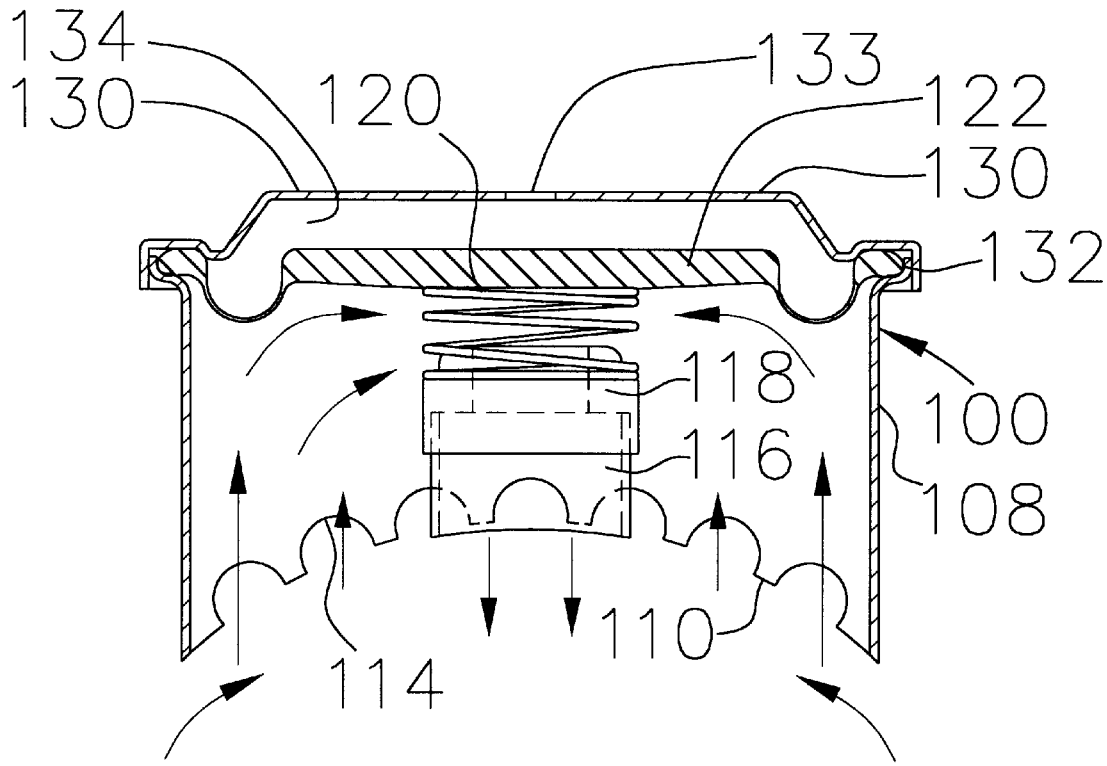
FIG. 4 is a cross-section schematic end view of a vacuum regulator from the apparatus of FIG. 1.
Figure 5:
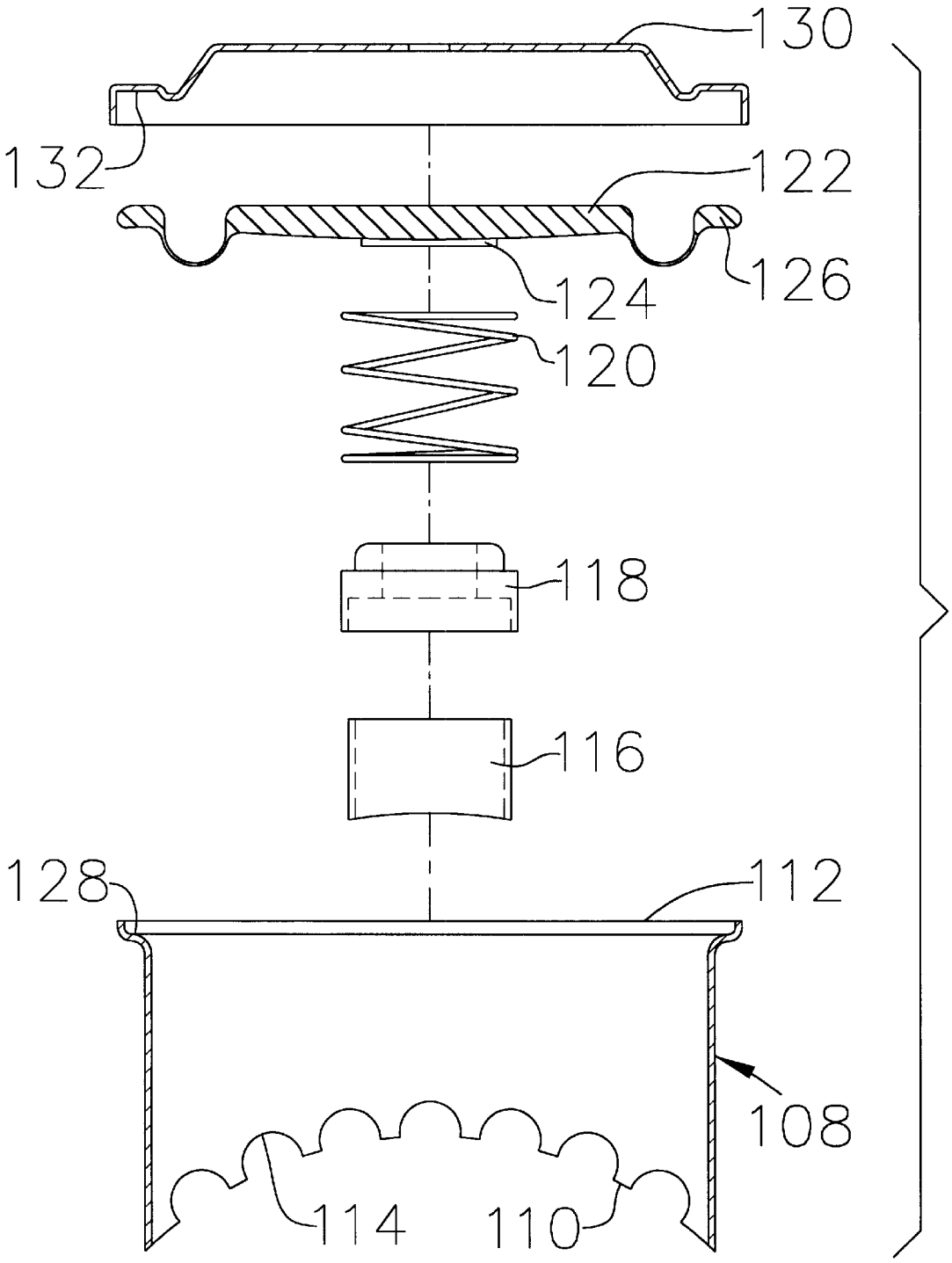
FIG. 5 is an exploded cross-section schematic end view of the vacuum regulator from FIG. 1.

FIGS. 4 and 5 illustrate the vacuum regulator 100 that is mounted within the separator apparatus housing 22. The vacuum regulator 100 comprises a housing 108 in the form of a wall that extends radially away from the inner channel wall 34 towards the outer channel wall 24. In a preferred embodiment, the vacuum regulator housing 108 is in the form of a cylindrical wall that is attached at a first end 110 to the inner channel wall 34. The housing wall extends radially through the second airflow passageway 104 and has an open second end 112 disposed within the first airflow passageway 102. The regulator housing first end 110 includes a number of openings 114 therethrough to facilitate the passage of air into the regulator housing 108 from the second airflow passageway 104 (as best shown in FIG. 4). It is desired that the regulator housing be formed from a structurally rigid material that is compatible with the material chosen for the separator apparatus.

An outlet tube 116 is disposed within the regulator housing 108 and is attached by conventional manner, such as by welding, to the inner channel wall 34 over the secondary outlet 46. It is desired that the outlet tube be formed from a structurally rigid material that is compatible with the material chosen for the separator apparatus. The outlet tube 166 serves to elevate the opening to the secondary outlet 46 to prevent the passage of separated oil therein. Attached to an open end of the outlet tube 116 is a vacuum regulator spring seat 118 that has a hollow passage therethrough to permit the passage of air to the outlet tube 116 and the secondary outlet 46. The spring seat 118 is constructed at one end to fit over the outlet tube, and is constructed at an opposite end to fit concentrically within a spring and prevent spring movement thereover. The spring seat can be formed from any suitable structurally rigid material, and can either be permanently or removably attached to the outlet tube 116.

A vacuum regulator spring 120 has one end that is positioned onto the spring seat 118. The spring 120 is sized and configured to provide a desired maximum vacuum within the separator apparatus housing 22 and imposed on an engine crankcase, when combined with the other elements forming the vacuum regulator. It is desired that the spring be selected to impose a slight vacuum within the separator apparatus housing 22 and on an engine crankcase to remove an oil-air mixture from the engine crankcase without both interfering with the efficient collection and removal of separated oil from the separator apparatus, and causing large amounts of oil and oil laden air to be pulled from the crankcase. In a preferred embodiment, the spring is selected to provide to the crankcase up to about 6 inches of water vacuum.

A movable diaphragm 122 is disposed over an end of the spring 120 opposite the spring seat 118. The diaphragm includes a stopper 24 that projects a distance outwardly away from a diaphragm surface, and that is designed to fit over and provide an air-tight seal against an adjacent end of the spring seat. The diaphragm 122 includes a lip 126 that extends circumferentially therearound and that defines a distal end of the diaphragm. The lip 126 is designed to fit within a flared portion 128 of the regulator housing open end 112.

A vacuum regulator cover 130 is disposed over regulator housing open end 112, fixing the diaphragm lip 126 between the housing open end 112 and an adjacent cover edge channel 132. The regulator cover 130 is a disk-shaped and is sized to fit over the housing open end and provide a air-tight interference fit therewith. The regulator cover 130 can be made from any type of suitable structurally rigid material. The regulator cover 130 includes an opening 133 therethrough to expose an air cavity 134, formed between the cover 130 and diaphragm 122, to atmospheric pressure air. The need to provide atmospheric pressure air to the vacuum regulator air cavity is critical to the proper functioning of the diaphragm to react to changes in vacuum at the outlet tube 116 and secondary outlet port.

The vacuum regulator 100 is designed to impose a slight vacuum in the crankcase, via the secondary inlet port 42 and suitable connection means. The presence of oil droplets or particles in the crankcase atmosphere is due partly to the relatively high pressure in the crankcase. By connecting the combination apparatus comprising such integral vacuum regulator to an engine, the pressure in the crankcase is eliminated and an actual slight vacuum replaces the high pressure crankcase atmosphere. This serves to significantly decrease the amount of oil, contaminants and blowby byproducts entrained in the crankcase air, and may reduce oil consumption by up to as much as 50%. It is significant that the vacuum created in the crankcase not be too large. Otherwise, a relatively large amount of oil and oil laden air will be pulled from the crankcase. For example, if the air-filter becomes clogged for any reason, the suction created by the turbo or the engine induction system would increase the pressure differential between the breather and the combination apparatus. The vacuum regulator 100 described below prevents the occurrence of too large of a pressure differential. The vacuum regulator limits the vacuum that is both maintained in the crankcase and that is maintained within the separator apparatus housing 22 by diaphragm movement vis-a-vis the secondary outlet port 46. If the vacuum developed inside of the apparatus housing 22 by action of the inlet air passing through the channel 26, and that is imposed on an engine crankcase by hose attachment between the secondary inlet 42 and a suitable engine crankcase attachment, is too large, the differential pressure on opposite sides of the diaphragm 122 causes the diaphragm to overcome the biasing pressure of the spring 120. Once the biasing pressure of the spring is overcome, the diaphragm is moved toward the spring seat 118 and the stopper 124 forms an air-tight seal against the spring seat 118 to seal off the secondary outlet 46, i.e., the vacuum generating source. Once the diaphragm stopper 124 is sealed against the spring seat 118, air flow through the first and second airflow passageways is stopped. Once the vacuum developed within the apparatus housing is reduced to an acceptable level, the differential pressure acting on the diaphragm is reduced and the biasing pressure of the spring is restored, causing the diaphragm stopper 124 to move away from the spring seat 118. Once the air-tight seal between the diaphragm stopper and the spring seat is broken, airflow through the vacuum regulator 100 and through the first and second airflow passageways, and a desired vacuum within the separator apparatus housing 22 and engine crankcase, is restored. Operation in this manner provides a closed crankcase ventilation system which complies with current requirements of the Clean Air Act.

Figure 6:
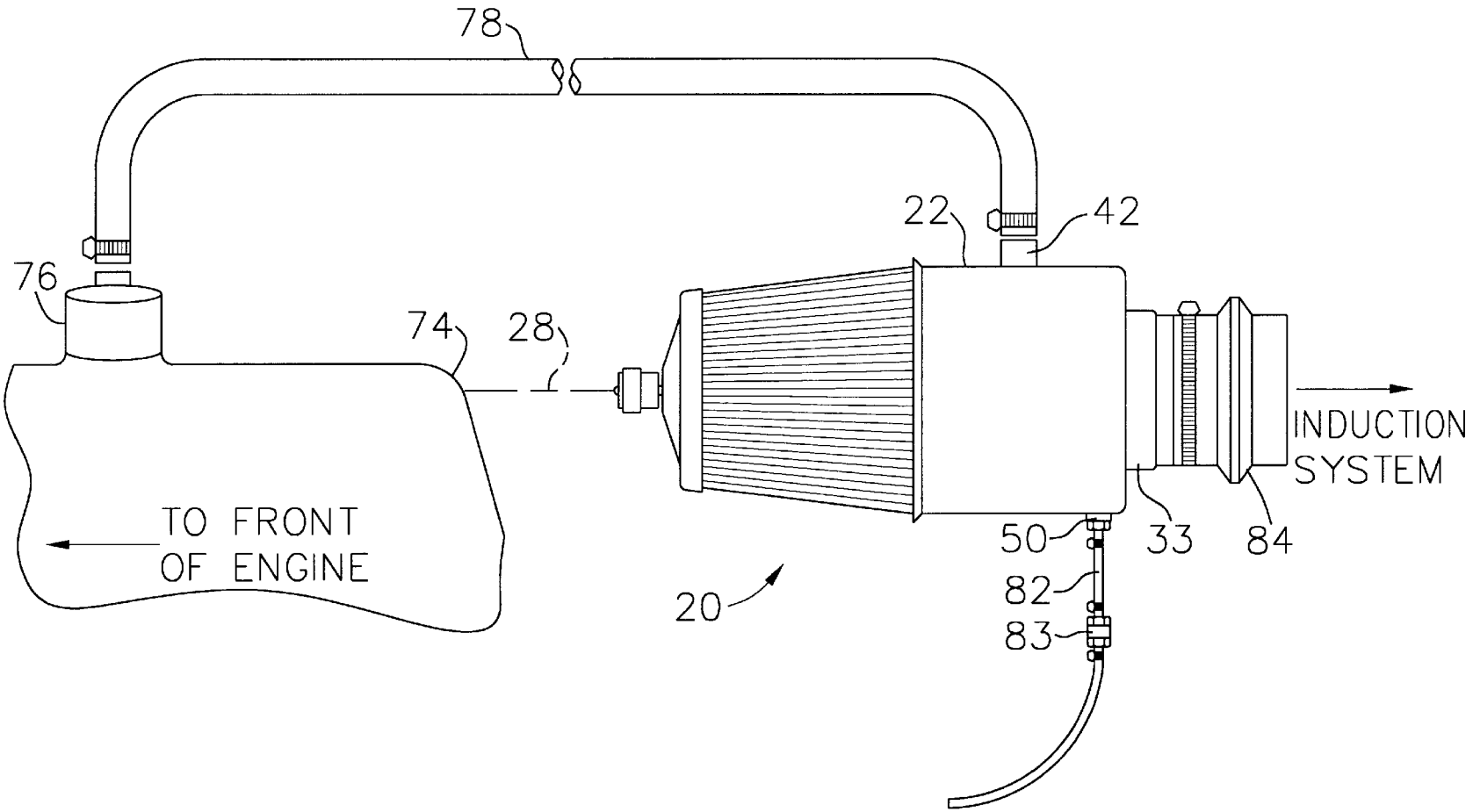
FIG. 6 is a schematic side elevation view of an engine incorporating the separator apparatus of FIG. 1.

FIG. 6 shows the system of the present invention connected to an internal combustion engine having an induction system 72, engine block 74 and an engine breather 76. The engine breather 76 is coupled through a hose 78 with the secondary inlet port 42 of the separator apparatus 20. The annular air-filter 100 and annular housing 22 are clearly visible. Air-silencer 90 and air-silencer cap 98 are not visible in FIG. 2 because they are contained within the channel formed by the annular air filter and annular housing and are thus hidden from view. A fluid line 82 extends from the drain coupling 50 on the bottom of the annular housing through a check valve 83 to the engine's oil reservoir. Check valve 83 prevents oil from being sucked up out of the oil reservoir into the combination apparatus. The primary gas outlet flange 33 of the combination apparatus 20 is coupled to a hose 84 running to the engine's intake air turbo, e.g., when the engine is a diesel engine. Alternatively, engines without turbos have the primary gas outlet of the combination apparatus coupled to the induction system for the engine. Generally, the filtering apparatus can be adapted to the crankcase and clean air intake systems of any internal combustion engine. The combination apparatus 20 is preferably oriented so that the axis 28 is oriented on the center line of a turbo charger for engines which are equipped with such devices.

By referencing FIGS. 1–5, consider now the operation of the combination apparatus. With the connections formed as shown in FIG. 6, the intake air turbo creates a vacuum for pulling air into the combination apparatus. (The same effect is produced without a turbo when the primary gas outlet 32 of the filtering apparatus is coupled to the induction system of the engine.) The air is pulled through the air filter 100, past silencer 90 and into the channel 26. The pulling effect of the turbo on the air in the channel produces a pressure differential between the secondary outlet 46 and the secondary gas inlet 42 forcing contaminated air to flow out from the engine breather 76 through the hose 78. The pressure differential between the secondary inlet 42 and the secondary outlet 46 is regulated by action of the vacuum regulator 100 as described above.

The contaminated air evacuated from the engine breather is introduced into the first airflow passageway 102 so that the air strikes the first baffle 50. The oil-contaminated air passes through the first and second airflow passageways 102 and 104 in the annular housing 22 along the flow lines indicated by the arrows 66 (FIG. 2). The oil in the contaminated air impacts and condenses or is adsorbed on the interior surface of the outer wall and the exterior surface of the first baffle 50. This process continues as the contaminated air flows about the first baffle until the engine air, now decontaminated, exits the secondary outlet 46 and enters the channel 26 and merges with the just filtered intake air. The merged air then continues along the channel 26 to the intake air turbo, which then transports the air to the engine as usual.

Oil that is separated from the entering contaminated air flows by gravity to the bottom of the apparatus housing, where it is collected and routed through the oil drain 54 into the fluid line 82 where it develops a sufficient head pressure that allows it to pass through the check valve 83 to the engine's oil reservoir. A feature of the combination apparatus of this invention comprising an integral vacuum regulator disposed therein is that it provides a regulated vacuum within the apparatus housing itself, thereby minimizing vacuum effects on the pressure head needed to ensure efficient oil flow and removal from the apparatus. This is contrasted with systems that use an external vacuum regulator or limiter position in-line between the separator apparatus and engine breather that only regulates the amount of vacuum imposed on the engine crankcase and not the separator apparatus. The sometimes large amounts of vacuum developed within such a separator apparatus can reduce the pressure head of oil within the fluid line, thereby adversely interfering with the efficient flow and removal of oil from the separator apparatus. The separator apparatus of this invention addresses this situation in a manner that eliminates the need for an ancillary external device, thereby providing a cleaner, easier, and less space consuming installation.

The combination apparatus may be designed for any type of engine, and its efficiency of can be changed by varying the diameter of the apparatus, i.e. increasing the surface area of the baffles and interior surfaces in the housing and increasing the cross-sectional area of the flow path, or increasing the axial length of the annular housing, with the same result. The throughput may be changed by changing the breather port or the secondary inlet and outlet cross-sectional areas. The cross-sectional area of the passageways in the interior of the filtering apparatus is preferably greater than or approximately equal to the cross-sectional area of the secondary outlet. This maintains a low flow velocity to the passageways.

The in-line arrangement of the filtering apparatus provides for a pressure differential between the breather and the channel 26 for transferring the contaminated air from the breather. The design requires little modification of the air intake design of current engines and is simple and economical to assemble. Significantly, the in-line design with the filtered air being supplied to the induction system and the oil being returned to the oil system produces a closed crankcase ventilation system. The system conserves oil, returns lighter unburned hydrocarbons to the induction system, creates a slight crankcase vacuum, increases fuel efficiency and prolongs engine lifetime.

Although limited embodiments of combination air-filter/air-oil separators with integral vacuum regulators and methods for making the same according to principles this invention have been described herein, many modifications and variations will be apparent to those skilled in the art. Accordingly, it is to be understood that, within the scope of the appended claims, combination air-filter/air-oil separators with integral vacuum regulators of this invention may be prepared other than as specifically described herein.

I claim:

1. A combination apparatus for use with an internal combustion engine for silencing and filtering air flow, separating air-contaminant mixtures, and regulating vacuum within the engine and apparatus, the apparatus comprising:

an annular housing having an outer wall;

an air filter joined to the annular housing;

a channel in the housing defining a central axis, having on one end of the channel a primary gas inlet coupled to the air filter, and having on the opposite end of the channel a primary gas outlet, and having a channel wall, the channel wall having inside and outside surfaces;

a secondary inlet port through the outer wall;

a secondary outlet port defining an opening in the channel wall such that there is no straight line flow path between the secondary inlet and the secondary outlet;

an oil drain that extends through the outer wall between the secondary inlet and secondary outlet for passing collected oil to an engine crankcase; and a vacuum regulator disposed within the housing between the secondary inlet and outlet ports to both control the amount of vacuum within the housing to permit oil transfer from the oil return passage, and to control the amount of vacuum imposed on the secondary inlet.

2. An apparatus as recited in claim 1 wherein the vacuum regulator is positioned within the housing next to the secondary outlet.

3. An apparatus as recited in claim 1 wherein the vacuum regulator comprises a diaphragm that is exposed on one side to a vacuum created within the channel, and on an opposite side to ambient atmospheric pressure.

4. An apparatus as recited in claim 1 wherein the vacuum regulator is positioned approximately 180 degrees from the oil drain.

5. An apparatus as recited in claim 1 wherein the vacuum regulator comprises a regulator housing and a diaphragm disposed therein that is positioned to prevent the passage of air from the regulator housing to the secondary outlet when a determined pressure differential at opposite sides of the diaphragm exists.

6. An apparatus as recited in claim 5 wherein the diaphragm is biased away from an opening to the secondary outlet port by a spring interposed therebetween.

7. An apparatus as recited in claim 5 wherein the regulator housing includes a number of openings therethrough to facilitate passage of air within the apparatus housing from the secondary inlet port to the secondary outlet port.

8. An apparatus as recited in claim 1 wherein the vacuum regulator comprises:

a regulator housing that extends within the apparatus housing and that is attached at one end to an inside surface of the channel wall;

a regulator lid attached over an open end of the regulator housing opposite the channel wall;

a diaphragm interposed between the regulator lid and regulator housing open end to form an air-tight seal therewith;

an air cavity between the diaphragm and regulator lid that is exposed to atmospheric pressure; and a spring interposed between the diaphragm and the secondary outlet port, wherein the diaphragm is adapted to form an air-tight seal with the secondary outlet port in response to a desired differential air pressure between the channel and air cavity.

9. A combination oil-air separating apparatus comprising:

an annular apparatus housing comprising an outer wall that defines an exterior surface of the housing, and a channel wall defining a primary air channel that passes axially through the housing, wherein the outer and channel walls are connected with each other at axial ends by radially extending side walls;

a secondary air inlet port extending though the outer wall to an airflow passageway within the housing between the outer and channel walls;

a secondary air outlet port extending through the channel wall to the primary air channel and in communication with the airflow passageway;

an oil drain line attached to the housing between the secondary air inlet and outlet ports and in communication with the airflow passage; and a vacuum regulating means disposed within the housing adjacent the secondary air outlet to regulate the amount of vacuum imposed on the airflow passageway to both enhance oil passage from the housing via the oil drain line, and to prevent oil passover from an engine crankcase breather connected to the airflow passageway.

10. An apparatus as recited in claim 9 wherein the airflow passageway is constructed within the housing so that there is no straight line flow path between the secondary air inlet and out ports.

11. An apparatus as recited in claim 9 wherein the apparatus housing further comprises a baffle interposed between the outer wall and channel wall that defines a first airflow passageway extending radially between the outer wall and one surface of the baffle, and that defines a second airflow passageway extending radially between the channel wall and an opposite surface of the baffle.

12. An apparatus as recited in claim 11 wherein the vacuum regulator is positioned within the first and second airflow passageways to receive airflow from only the second airflow passageway.

13. An apparatus as recited in claim 11 wherein the first airflow passway receives airflow from the secondary air inlet port and directs it in a first direction through the housing, and the second airflow passageway receives airflow from the first airflow passageway and directs is a second opposite direction through the housing to the vacuum regulator.

14. An apparatus as recited in claim 9 wherein the vacuum regulating means comprises:

a regulator housing that is disposed within the apparatus housing between the outer and channel walls; and a diaphragm means disposed within the regulator housing that is positioned to close an opening to the secondary air outlet port in response to a determined differential pressure across the diaphragm.

15. An apparatus as recited in claim 14 wherein the vacuum regulating means further comprises a spring means interposed between the opening to the secondary air outlet port and the diaphragm to bias the diaphragm away from the opening until a determined differential pressure across the diaphragm is reached.

16. An apparatus as recited in claim 15 where in the regulator housing includes an air cavity on a side of the diaphragm opposite the opening to the secondary air outlet port that is vented to atmospheric pressure air.

17. A combination oil-air separating apparatus comprising:

an annular apparatus housing comprising an outer wall that defines an exterior surface of the housing, and a channel wall defining a primary air channel that passes axially through the housing, wherein the outer and channel walls are connected with each other at axial ends by radially extending side walls;

a secondary air inlet port extending though the outer wall to an airflow passageway within the housing between the outer and channel walls, the secondary air inlet port being connected to an engine crankcase breather to receive an air-oil mixture;

a secondary air outlet port extending through the channel wall to the primary air channel and in communication with the airflow passageway;

a baffle interposed concentrically between the housing outer and channel walls defining a first airflow passageway radially between the outer wall and one baffle surface, and defining a second airflow passageway radially between the channel wall and an opposite baffle surface, wherein an air-oil mixture from a crankcase breather entering through the secondary air inlet passes in a first direction through the first airflow passageway, and in a second opposite direction through the second airflow passageway to the secondary air outlet;

an oil drain connected to the housing between the secondary inlet and outlet ports for removing separated collected oil from the apparatus; and a vacuum regulating means disposed within the housing adjacent the secondary air outlet to regulate the amount of vacuum imposed on the first and second airflow passageways within the apparatus housing to both control the amount of vacuum imposed on a crankcase breather and on collected oil disposed within oil drain.

18. An apparatus as recited in claim 17 wherein the vacuum regulating means comprises:

a vacuum regulator housing that forms a vacuum chamber therein that is in airflow communication with the secondary air outlet;

a diaphragm disposed within the vacuum chamber that forms an air-tight seal therewith, wherein the diaphragm is positioned adjacent an opening to the secondary air outlet port, and wherein an opposite surface of the diaphragm is exposed to atmospheric pressure air so that under operating conditions a differential pressure is imposed across the diaphragm; and a spring means interposed between the diaphragm and the opening to the secondary air outlet port to impose a determined biasing force against the diaphragm.

19. A method for separating oil from an air-oil mixture using a separator apparatus and maintaining a determined vacuum therein, the method comprising the steps of:

passing and filtering an intake air stream through a primary air channel within the separator apparatus;

exposing an airflow passageway within the separator apparatus to the intake air stream to create a relatively low pressure condition within the passageway;

routing an oil-air mixture from an engine crankcase breather into the airflow passageway where the mixture velocity is reduced and the mixture is condensed;

collecting oil condensed from the oil-air mixture by gravity flow within the airflow passageway and passing the collected oil to an engine crankcase;

regulating the pressure within the airflow passageway so that a vacuum drawn on the breather and on the collected oil does not exceed a determined vacuum level; and passing air from the oil-air mixture to the primary air channel for combining with the intake air stream.

20. A method as recited in claim 19 wherein the step of routing comprises passing the oil-air mixture entering the apparatus through a first airflow passageway in a first direction, and then through a second airflow passageway in an opposite second direction.

21. A method as recited in claim 19 wherein the step of regulating comprises subjecting a diaphragm disposed across an opening to the primary air channel to a differential pressure comprising atmospheric air pressure on one diaphragm surface, and air pressure at an opening to the primary air channel on an opposite diaphragm surface.

* * * * *